US011993933B1

(12) United States Patent
Pitre

(10) Patent No.: US 11,993,933 B1
(45) Date of Patent: May 28, 2024

(54) WALL STUD

(71) Applicant: Jacque Elliott Pitre, Marksville, LA (US)

(72) Inventor: Jacque Elliott Pitre, Marksville, LA (US)

( * ) Notice: Subject to any disclaimer, the term of this patent is extended or adjusted under 35 U.S.C. 154(b) by 0 days.

(21) Appl. No.: 17/367,255

(22) Filed: Jul. 2, 2021

Related U.S. Application Data

(60) Provisional application No. 63/047,670, filed on Jul. 2, 2020.

(51) Int. Cl.
*E04C 3/36* (2006.01)
*E04B 1/94* (2006.01)

(52) U.S. Cl.
CPC ..... *E04C 3/36* (2013.01); *E04B 1/943* (2013.01)

(58) Field of Classification Search
CPC . E04B 2/7863; E04B 2/60; E04B 1/19; E04B 1/943; E04C 3/02; E04C 3/30; E04C 3/36
See application file for complete search history.

(56) References Cited

U.S. PATENT DOCUMENTS 1,880,453 A * 10/1932 Kantzler ..... E04B 2/7863 52/393
2,101,074 A * 12/1937 Kotrbaty ..... E04B 2/60 52/220.2
2,121,962 A * 6/1938 Glass ..... E04B 2/845 181/295
2,138,291 A * 11/1938 Callaghan ..... E04C 3/32 52/634
2,635,716 A * 4/1953 Mayes ..... E04C 3/32 52/762
2,815,832 A * 12/1957 Schwartz ..... E04H 1/1238 52/509
3,349,535 A * 10/1967 Balinski ..... E04C 3/09 52/634
3,381,439 A * 5/1968 Thulin, Jr. ..... E04C 3/086 52/840
4,364,212 A 12/1982 Pearson et al.
5,499,480 A * 3/1996 Bass ..... E04C 3/07 52/696
5,664,388 A * 9/1997 Chapman ..... E04C 3/065 52/745.1
5,809,734 A * 9/1998 Turner ..... E04C 3/36 52/843
5,904,025 A * 5/1999 Bass ..... E04G 23/0218 52/745.12

(Continued)

*Primary Examiner* — Gisele D Ford
(74) *Attorney, Agent, or Firm* — Kenneth L. Tolar

(57) ABSTRACT

An improved wall stud includes a pair of spaced rails, each having a planar outer surface for attaching an exterior cladding substrate or wall board, an inner surface, an upper end, and a lower end. The inner surface has a substantially triangular cross-section to prevent the rail from bowing. The upper end of each rail includes an opening in communication with a mortise for telescopically receiving an elongated tenon projecting from the lower end of each rail. Accordingly, two or more studs can be quickly and easily joined to form a longer stud, if needed. The spaced rails are interconnected with a series of uniquely designed reinforcement members that prevent the studs from bending, twisting, contorting, or deforming when subjected to undue force.

31 Claims, 3 Drawing Sheets

(56) References Cited

U.S. PATENT DOCUMENTS 6,263,629 B1 * 7/2001 Brown, Jr. ..... E04C 2/044 442/179
6,481,175 B2 * 11/2002 Potter ..... E04C 3/32 52/634
7,866,112 B2 * 1/2011 Edmondson ..... E04C 3/07 52/646
8,171,696 B2 * 5/2012 Powers, III ..... E04C 3/08 52/693
8,225,581 B2 * 7/2012 Strickland ..... E04C 3/07 52/855
8,234,836 B2 * 8/2012 Anderson ..... E04C 3/09 52/843
8,276,328 B2 * 10/2012 Pepin ..... E04B 1/34838 52/657
8,366,083 B1 * 2/2013 Herrmann ..... B25B 5/068 52/693
8,615,957 B1 * 12/2013 Sacks ..... E04C 3/08 52/654.1
8,677,716 B2 * 3/2014 Anderson ..... E04C 3/09 52/645
9,752,323 B2 9/2017 Sacks et al.
9,790,686 B1 10/2017 Samuels
10,760,266 B2 * 9/2020 Sacks ..... E04B 2/62
2001/0052205 A1 12/2001 Herren
2004/0093822 A1 * 5/2004 Anderson ..... E04C 3/09 52/635
2006/0075715 A1 * 4/2006 Serpico ..... E04B 1/24 52/648.1
2006/0144008 A1 * 7/2006 Fouch ..... E04B 1/26 52/292
2006/0185315 A1 8/2006 Walker
2007/0089374 A1 * 4/2007 Vasta ..... E04C 3/07 52/204.2
2008/0250747 A1 * 10/2008 Johnson ..... E04C 3/16 52/693
2009/0165416 A1 * 7/2009 Porter ..... E04B 2/7453 52/653.1
2015/0240486 A1 * 8/2015 Sacks ..... E04C 5/07 52/633
2018/0328017 A1 * 11/2018 Collins ..... E04B 5/026
2019/0284797 A1 * 9/2019 Pilz ..... B32B 15/085

* cited by examiner

WALL STUD

This application claims priority of provisional application No. 63/047,670 filed on Jul. 2, 2020, the specification of which is incorporated herein by reference.

BACKGROUND OF THE INVENTION

The present invention relates an improved wall stud that is lighter, stronger, and more durable than a conventional wall stud.

DESCRIPTION OF THE PRIOR ART

Studs are used to frame walls for residential and commercial buildings. A conventional stud is constructed with wood or steel depending upon the application. Typically, wooden wall studs are used in residential and lighter commercial buildings because they are cheaper, easier to cut to a desired length and more readily available than steel studs. However, wooden studs are flammable and are susceptible to termite infestations, rotting and water damage. Furthermore, bridging systems, which interlock and reinforce a series of parallel studs, cannot be used with wooden studs. Therefore, the height of wooden studs is limited due to the amount of axial force a wooden stud can withstand.

Because of the aforementioned problems, metal studs are used in larger commercial buildings where fires can be much more devastating. However, steel studs are not infallible because they rust, are more expensive and are conductive, and therefore not as insulating as walls with wooden studs. Furthermore, because metal studs are highly conductive, they collapse quickly in the presence of extreme heat emanating from a large fire.

Accordingly, there is currently a need for a wall stud that overcomes the disadvantages of wooden and steel studs. A review of the prior art reveals a few wall studs that purportedly address a few of the disadvantages of conventional wall studs. For example, U.S. Pat. No. 9,752,323 to Sacks discloses a lightweight metal stud comprising a pair of spaced channel members with an X-shaped wire matrix positioned therebetween for receiving utility lines.

U.S. published patent application no. 2006/0185315 to Walker discloses a wall stud including two spaced sidewalls with a panel extending therebetween. The panel includes a curved indention that allows the stud to flex slightly to absorb vibrational energy emanating from soundwaves.

U.S. patent publication no. 2009/0165416 to Porter discloses a thermal wall stud comprising an I-beam having a central web positioned between two spaced flanges. Geometrically shaped apertures are longitudinally spaced along the central axis of the web that form narrow strips to minimize conductivity between the spaced flanges while enhancing strength.

U.S. Pat. No. 9,790,686 issued to Samuels et al. discloses a triangular stud that nests in notched floor and ceiling runners so that drywall screws are inserted into the void space within the triangular stud as opposed to the exposed inner space of a shaft wall.

U.S. Pat. No. 4,364,212 issued to Pearson discloses a fire-resistant metal stud having a front flange to which a wall is attached and a rear flange that includes a double thickness of loosely folded sheet metal. The space formed by the folded sheet metal provides a chimney for cooling the hottest portions of the stud during a fire. The rear flange also includes holes for allowing cooler air from the unexposed side of the stud to enter the chimney.

U.S. published patent application no. 2001/0052205 to Herren discloses a stud for constructing fire and seismic-resistant shaft walls including a rear flange with slots and a shorter front flange with apertures.

As indicated above, a few wall studs exist in the prior art that are purportedly designed to withstand heat and external forces. The patent to Sacks discloses a stud with an X-shaped wire matrix that accommodates utility lines. The matrix is neither intended nor designed to enhance strength to prevent the stud from twisting or contorting. Porter merely discloses a stud with geometric formations and thin necks positioned between two flanges to minimize thermal conductivity.

None of the above-cited references include a wall stud that are specifically designed to prevent the stud from bending, twisting, contorting, or deforming when subjected to undue force. The present invention provides a uniquely designed wall stud formed of a pair of spaced rails interconnected with a myriad of uniquely positioned reinforcement members that prevent the stud from twisting, bending, or contorting. Furthermore, the wall stud is configured to easily connect to another identical wall stud to form a longer stud if needed. Finally, the wall stud according to the present invention is constructed with a lightweight, inflammable, nonconductive material that will not bend, melt, rot, or rust and is immune to water or termite intrusion.

SUMMARY OF THE INVENTION

The present invention relates to an improved wall stud comprising a pair of spaced rails, each having a planar outer surface for attaching an exterior cladding substrate or wall board, an inner surface, an upper end, and a lower end. The inner surface has a substantially triangular cross-section to prevent the rail from bowing. The upper end of each rail includes an opening in communication with a mortise for telescopically receiving an elongated tenon projecting from the lower end of each rail. Accordingly, two or more studs can be quickly and easily joined to form a longer stud, if needed. The spaced rails are interconnected with a series of uniquely designed reinforcement members that prevent the studs from bending, twisting, contorting, or deforming when subjected to undue force.

It is therefore an object of the present invention to provide an improved wall stud that is lighter yet stronger than conventional wall studs.

It is therefore another object of the present invention to provide an improved wall stud that is substantially lighter than conventional wall studs while being resistant to rust, rot, and fire.

It is yet another object of the present invention to provide an improved wall stud having a series of reinforcement members that prevent the stud from twisting, contorting, or separating when subjected to a significant force.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
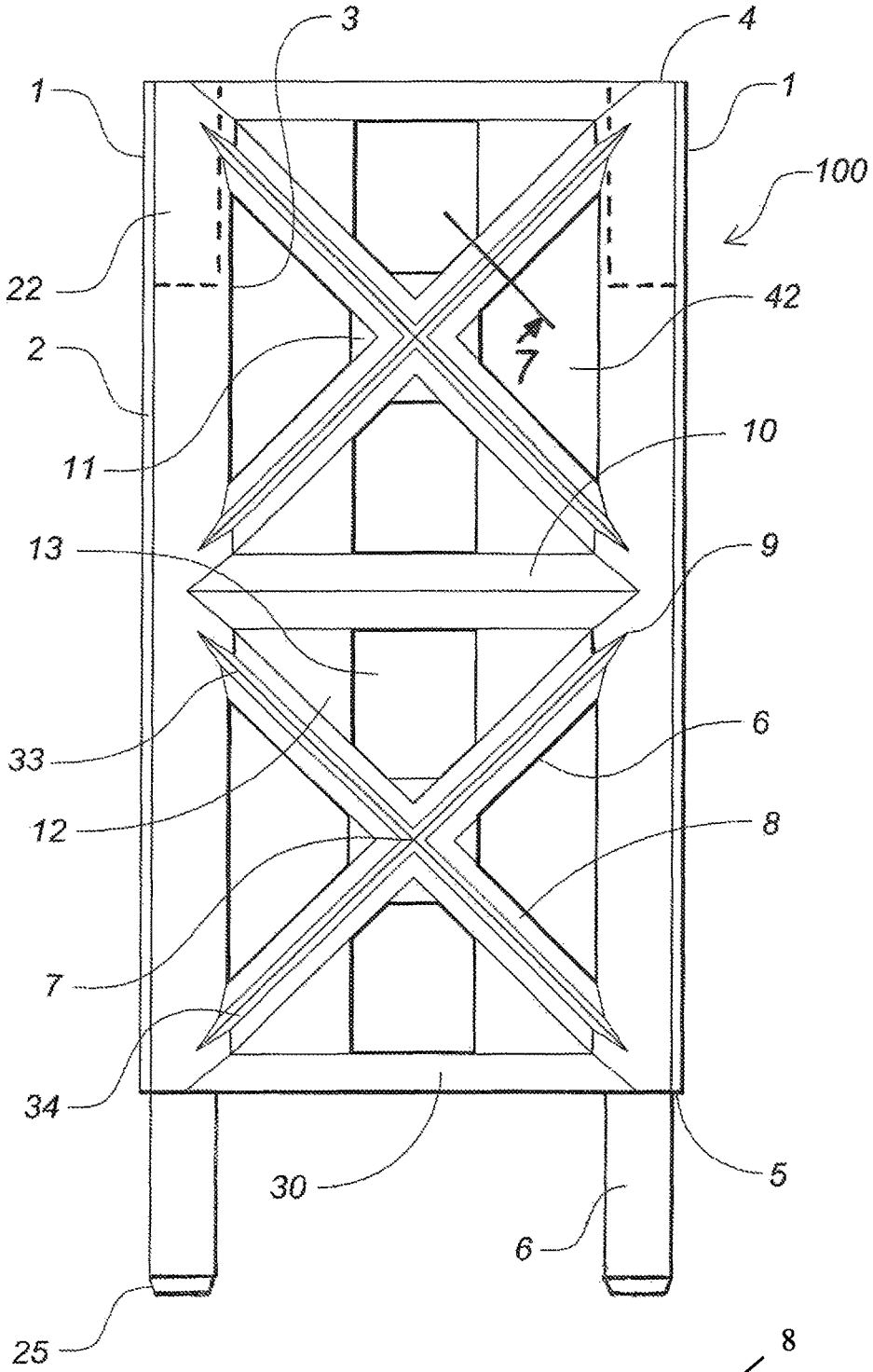
FIG. 1 is a plan view of the wall stud according to the present invention.
Figure 2:
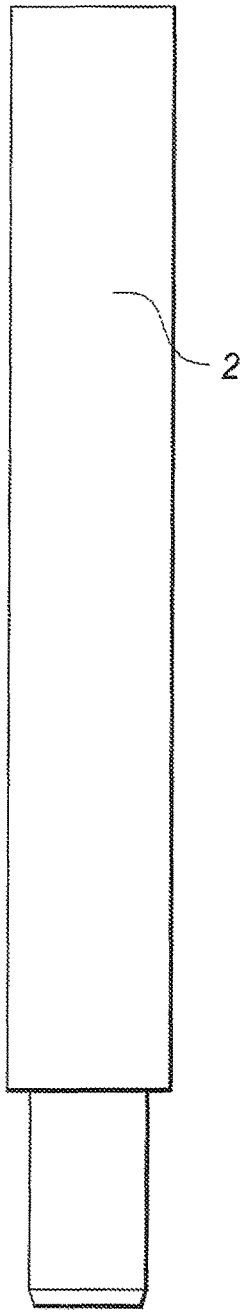
FIG. 2 is a side view of the wall stud.
Figure 7:
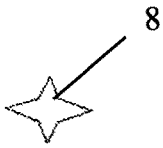
FIG. 7 is a cross-sectional view of an exemplary strut.
Figure 3:
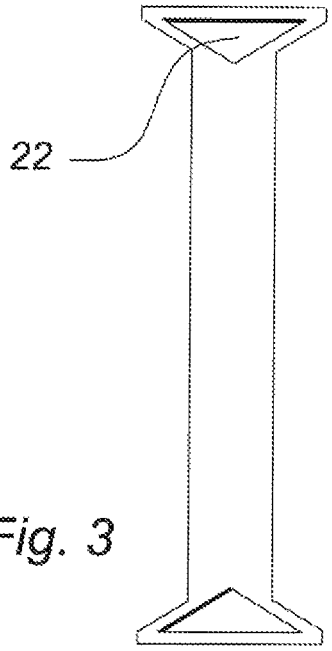
FIG. 3 is a top view of the wall stud.
Figure 4:
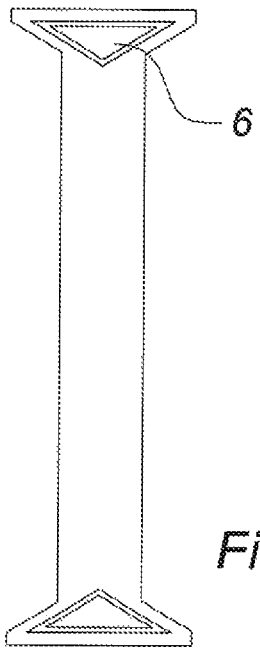
FIG. 4 is a bottom view of the wall stud.
Figure 5:
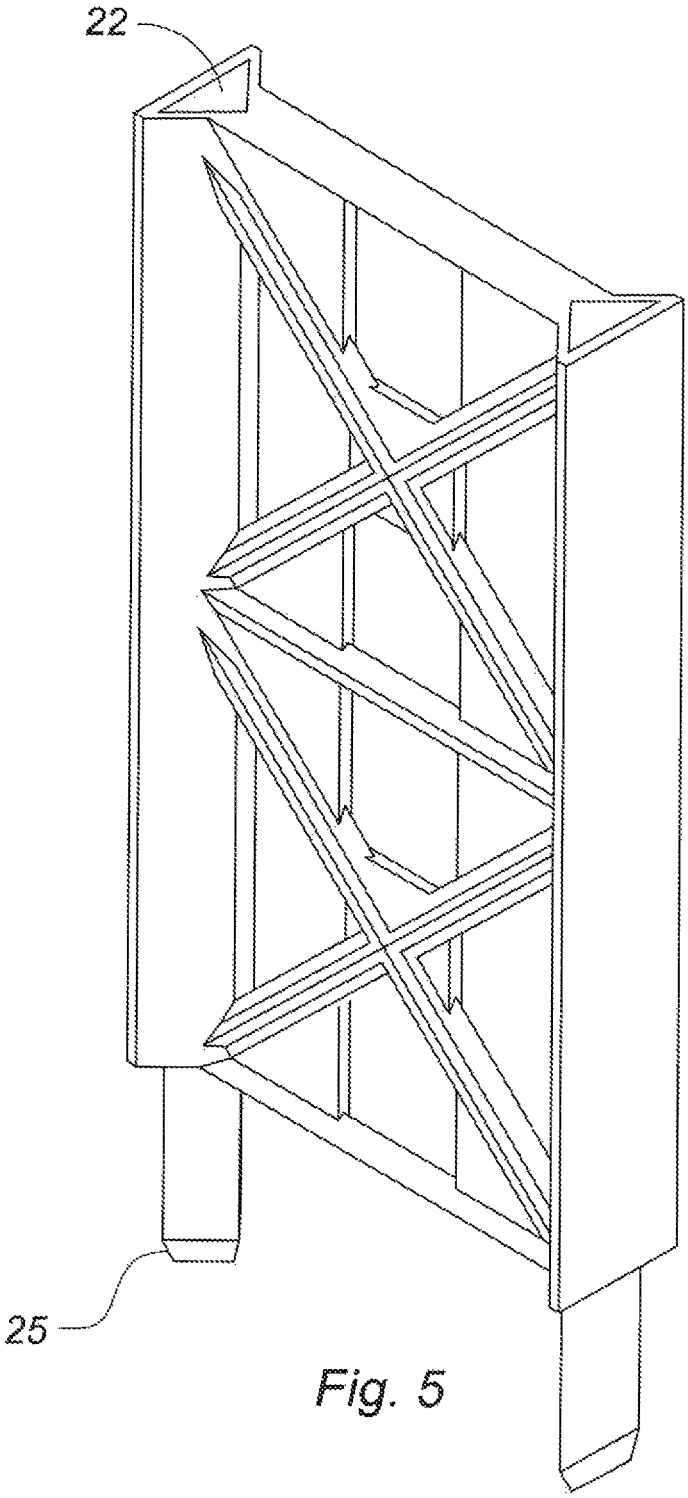
FIG. 5 is a perspective view of the wall stud.
Figure 6:
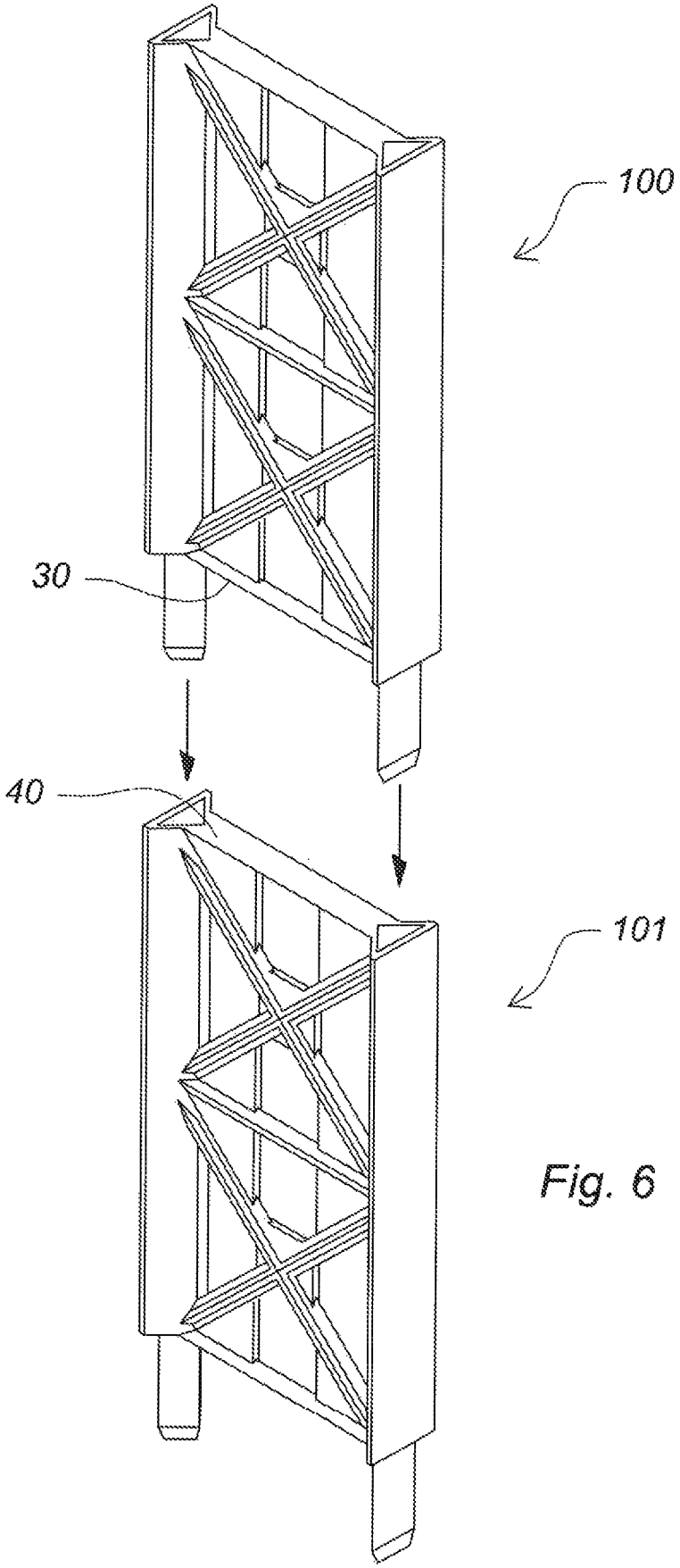
FIG. 6 depicts a first segment in position to connect to a second segment.

An improved wall stud includes one or more stud segments 100, 101 comprising a pair of spaced rails 2, each having an outer surface 1, an inner surface 3, an upper end 4, and a lower end 5. The spaced rails 2 are interconnected with a horizontal header 40 and a horizontal lower beam 30, each having a triangular cross section. The outer surface 1 of each rail is planar for attaching a wall component, such as exterior cladding substrate or wall board. The inner surface 3 has a substantially triangular cross-section to prevent the rail from bowing under pressure. The upper end 4 of each rail includes an opening 22 in communication with a mortise 22 for telescopically receiving an elongated tenon 6 projecting from the lower end of each rail. Accordingly, two or more stud segments 100, 101 can be quickly and easily joined to form a longer stud, if needed, as depicted in FIG. 6. Preferably, the lower end 25 of each tenon is tapered to facilitate insertion into the mortise 22.

The spaced rails 2 are interconnected with a series of reinforcement members that significantly enhance the structural integrity of the stud segment. One reinforcement member includes an X-shaped brace member 7 formed of two intersecting struts 8, each having a star-shaped cross section. The star-shaped configuration equalizes pressure in four distinct directions to relieve stress on the rails. Each end of the strut forms a chamfered joint 9 with the inner surface 3 of a rail 2 to prevent the rail from twisting under duress.

Another reinforcement member is a central, horizontal rib 10 extending between the spaced rails and positioned between adjacent brace members 7 that prevents separation and deformation of the spaced rails 2. Preferably, the rib 10 has a diamond-shaped or rhomboidal cross section that minimizes twisting of the side rails. The triangular lower beam 30 of one segment 100 mates with the triangular header 40 on another stud segment 101 to form a second rhomboidal rib when two segments are joined to form a longer stud.

At the intersection of the struts 8 is a buttressing plate 11 that prevents the stud from pivoting in the x, y, and z planes and prevents the brace member intersection from cracking or fracturing. A pair of spaced, triangular fins 12 are positioned between the central rib 10 and the upper 33 or lower segments 34 of the intersecting struts. The flanges provide additional structural integrity by interconnecting the central rib and struts.

The space between left and right fins forms an opening 13 for a bridge to be passed through a series of aligned, erected studs to prevent horizontal deflection caused by horizontal forces, axial compression, and torsional rotation of the studs. The bridge is typically an elongated, hollow tube having an O or D-shaped cross section that is connected to similar tubes passing through the aligned wall studs. A trapezoidal opening 42 on each side of the stud, between the plate 11, the struts 8 and side rail 1, eliminates unnecessary materials of construction and reduces the overall weight of the stud.

Preferably, the stud as described herein is constructed with a blend of, but not limited to, nylon, carbon fiber and a fire-retardant material. Moreover, each component is substantially hollow and filled with fire-resistant pellets or simply blended therewith. However, as is readily to anyone skilled in the art, the device can be constructed with any similar equivalent.

As is readily apparent from the detailed description set forth above, the present invention provides a uniquely designed wall stud having a myriad of uniquely configured and positioned reinforcement members that prevent the stud from twisting, bending, or contorting. Furthermore, the wall stud is configured to easily connect to another identical wall stud to form a longer stud if needed. Finally, the wall stud according to the present invention is constructed with a lightweight, inflammable, nonconductive material that will not bend, melt, rot, or rust and is immune from water or termite damage.

The above-described device is not limited to the exact details of construction and enumeration of parts provided herein. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A wall stud comprising:

at least one stud segment having a pair of spaced rails, each of said spaced rails having an outer surface, an inner surface, an upper end, and a lower end; each of said spaced rails having a triangular cross section with an apex forming the inner surface of said each of said spaced rails to prevent said spaced rails from bowing under pressure;

a plurality of reinforcement members interconnecting the apex of one of said spaced rails with the apex of another of said spaced rails to structurally enhance said stud segment;

an opening at the upper end of each of said spaced rails; said opening in communication with a mortise;

an elongated tenon projecting from the lower end of each of said spaced rails for inserting into said mortise to join said stud segment to a second stud segment to form a longer stud.

2. The wall stud according to claim 1 wherein the tenon includes a lower tapered end to facilitate insertion into said mortise.

3. The wall stud according to claim 1 wherein the outer surface of each of said spaced rails is planar for attaching a wall component.

4. The wall stud according to claim 1 wherein one of said reinforcement members is an X-shaped brace member formed of two intersecting struts interconnecting the apex of one of said spaced rails with the apex of another of said spaced rails.

5. The wall stud according to claim 4 wherein said two intersecting struts have a star-shaped cross section for equalizing pressure in multiple directions.

6. The wall stud according to claim 5 wherein a distal end of each of said two intersecting struts forms a chamfered joint with the inner surface of one of said pair of spaced rails to prevent twisting under duress.

7. The wall stud according to claim 1 wherein another of said reinforcement members is a horizontal rib extending between the spaced rails that prevents separation and deformation of said spaced rails.

8. The wall stud according to claim 5 further comprising a buttressing plate attached to said intersecting struts that prevents the stud from pivoting within multiple planes.

9. The wall stud according to claim 8 further comprising a triangular fin positioned between the horizontal rib and the intersecting struts that structurally enhances the stud segment by connecting the central rib to said intersecting struts.

10. The wall stud according to claim 9 further comprising an opening adjacent the triangular fin and said struts for a receiving a bridge.

11. The wall stud according to claim 1 wherein said stud segment is constructed with a nonconductive, inflammable material.

12. The wall stud according to claim 7 wherein said horizontal rib has a rhomboidal cross section that minimizes twisting of the side rails.

13. The wall stud according to claim 1 further comprising a horizontal header and a horizontal lower beam extending between said side rails.

14. The wall stud according to claim 13 wherein said horizontal header and said horizontal lower beam have a triangular cross section.

15. The wall stud according to claim 13 wherein the lower beam of one stud mates with the header on another stud segment to form a second rib having a rhomboidal cross section when two segments are joined to form a longer stud.

16. The wall stud according to claim 11 wherein said nonconductive, nonflammable material is a blend of nylon, carbon fiber and a fire-retardant material.

17. A wall stud comprising:

at least one stud segment having a pair of spaced rails, each of said spaced rails having an outer surface, an inner surface, an upper end, and a lower end; each of said spaced rails having a triangular cross section with an apex forming the inner surface of said each of said spaced rails to prevent said spaced rails from bowing under pressure;

a plurality of reinforcement members interconnecting the apex of one of said spaced rails with the apex of another of said spaced rails to structurally enhance said stud segment, wherein one of said reinforcement members is an X-shaped brace member formed of two intersecting struts interconnecting the apex of one of said spaced rails with the apex of another of said spaced rails; wherein said two intersecting struts have a star-shaped cross section for equalizing pressure in multiple directions, and wherein a distal end of each of said two intersecting struts forms a chamfered joint with the inner surface of one of said pair of spaced rails to prevent twisting under duress.

18. The wall stud according to claim 17 wherein the outer surface of each of said spaced rails is planar for attaching a wall component.

19. The wall stud according to claim 17 further comprising:

an opening at the upper end of each of said spaced rails; said opening in communication with a mortise;

an elongated tenon projecting from the lower end of each of said spaced rails for inserting into said mortise to join said stud segment to a second stud segment to form a longer stud.

20. The wall stud according to claim 19 wherein the tenon includes a lower tapered end to facilitate insertion into said mortise.

21. The wall stud according to claim 17 wherein another of said reinforcement members is a horizontal rib extending between the spaced rails that prevents separation and deformation of said spaced rails.

22. The wall stud according to claim 17 further comprising a buttressing plate attached to said intersecting struts that prevents the stud from pivoting within multiple planes.

23. The wall stud according to claim 21 further comprising a triangular fin positioned between the horizontal rib and the intersecting struts that structurally enhances the stud segment by connecting the horizontal rib to said intersecting struts.

24. The wall stud according to claim 23 further comprising an opening adjacent the triangular fin and said struts for a receiving a bridge.

25. The wall stud according to claim 17 wherein said stud segment is constructed with a nonconductive, inflammable material.

26. The wall stud according to claim 17 wherein each of said struts has two opposing ends, each of said ends forming a chamfered joint with the inner surface of one of said rails to prevent the rail from twisting under duress.

27. The wall stud according to claim 21 wherein said horizontal rib has a rhomboidal cross section that minimizes twisting of the side rails.

28. The wall stud according to claim 17 further comprising a horizontal header and a horizontal lower beam extending between said side rails.

29. The wall stud according to claim 28 wherein said horizontal header and said horizontal lower beam have a triangular cross section.

30. The wall stud according to claim 28 wherein the lower beam of one stud mates with the header on another stud segment to form a second rib having a rhomboidal cross section when two segments are joined to form a longer stud.

31. The wall stud according to claim 25 wherein said nonconductive, nonflammable material is a blend of nylon, carbon fiber and a fire-retardant material.

* * * * *